US005823914A

United States Patent [19]

Chen

[11] Patent Number: 5,823,914

[45] Date of Patent: Oct. 20, 1998

[54] EXERCISING DEVICE

[76] Inventor: Chih-Liang Chen, No. 10, La. 1431, Kuanghsing Rd., Pateh City, Taoyuan Hsien, Taiwan

[21] Appl. No.: 931,475

[22] Filed: Sep. 16, 1997

[51] Int. Cl.[6] ..... A63B 69/16; A63B 22/04

[52] U.S. Cl. ..... 482/51; 482/52; 482/57

[58] Field of Search ..... 482/52, 57, 70, 482/51, 53, 79, 80

[56] References Cited

U.S. PATENT DOCUMENTS

| | | | |
|---|---|---|---|
| 5,242,343 | 9/1993 | Miller | 482/52 X |
| 5,423,729 | 6/1995 | Eschenbach | 482/57 X |
| 5,573,481 | 11/1996 | Piercy et al. | 482/52 |
| 5,577,985 | 11/1996 | Miller | 482/52 |
| 5,674,821 | 10/1997 | Johnston | 482/51 X |
| 5,685,804 | 11/1997 | Whan-Tong et al. | 482/51 |
| 5,733,227 | 3/1998 | Lee | 482/52 |
| 5,755,642 | 5/1998 | Miller | 482/70 X |
| 5,755,643 | 5/1998 | Sands | 482/57 |
| 5,759,135 | 6/1998 | Chen | 482/70 X |
| 5,759,136 | 7/1998 | Chen | 482/52 |

*Primary Examiner*—Stephen R. Crow
*Assistant Examiner*—William LaMarea
*Attorney, Agent, or Firm*—Bacon & Thomas

[57] ABSTRACT

A foot exercising device includes a frame, an energy-transmitting mechanism, a first drum, a second drum, and a pair of pedals. The energy-transmitting mechanism is mounted on the frame. The first drum is interactively coupled with the energy-transmitting mechanism for transmitting rotational energy thereto, and the second drum is interactively coupled with the energy-transmitting mechanism for transmitting rotational energy thereto. Each pedal has an elongate slot to receive a rolling element therein. One end of the rolling element is rollingly and eccentrically connected with one end surface of the first drum for rotating the first drum. Each pedal is pivotably connected with the second drum by an elongate connecting rod, wherein each rolling element is received in each elongate slot to be capable of rolling along the elongate slot of each pedal. One end of each connecting rod is pivotably connected with one end of each pedal, and another end of each connecting rod is pivotably and eccentrically connected with the aforementioned one end surface of the second drum. The pedals can be alternatively stepped down to drive the first and second drums into rotation and to follow a smooth path.

8 Claims, 6 Drawing Sheets

EXERCISING DEVICE

BACKGROUND OF THE INVENTION

The present invention relates to an exercising device, and more particularly to an exercising device which can be operated smoothly.

Generally, in conventional exercising devices, pedals are fixedly mounted with the rotating element associated thereof. Therefore, they are not operated smoothly and comfortably.

Besides, conventional exercising devices have a significant volume. Therefore, storage for them will occupy large space.

In view of the foregoing, applicant has invented an improved foot exercising device to eliminate the above-mentioned drawbacks.

BRIEF SUMMARY OF THE INVENTION

The primary object of the present invention is to provide a compact exercising device which can be operated in a smooth and comfortable manner.

In accordance with one aspect of the present invention, an embodiment comprises a frame, an energy-transmitting mechanism mounted on the frame, a first drum interactively coupled with the energy-transmitting mechanism for transmitting rotational energy thereto, a second drum interactively coupled with the energy-transmitting mechanism for transmitting rotational energy thereto and a pair of pedals. Each pedal has an elongate slot to receive a rolling element therein. One end of the rolling element is rollingly and eccentrically connected with one end surface of the first drum for rotating the first drum. Each pedal is pivotably connected with the second drum by an elongate connecting rod, wherein each rolling element is received in the elongate slot to be capable of rolling along the elongate slot of each pedal. One end of each connecting rod is pivotably connected with one end of each pedal. Another end of each connecting rod is pivotably and eccentrically connected with the aforementioned end surface of the second drum. The pedals can be alternatively stepped down to drive the first and second drums into rotation and to follow a smooth path.

Other advantages and novel aspects of the invention will become more apparent from the following detailed description when taken in conjunction with the accompanying drawings.

DETAIL DESCRIPTION OF THE PREFERRED EMBODIMENT

Figure 1:
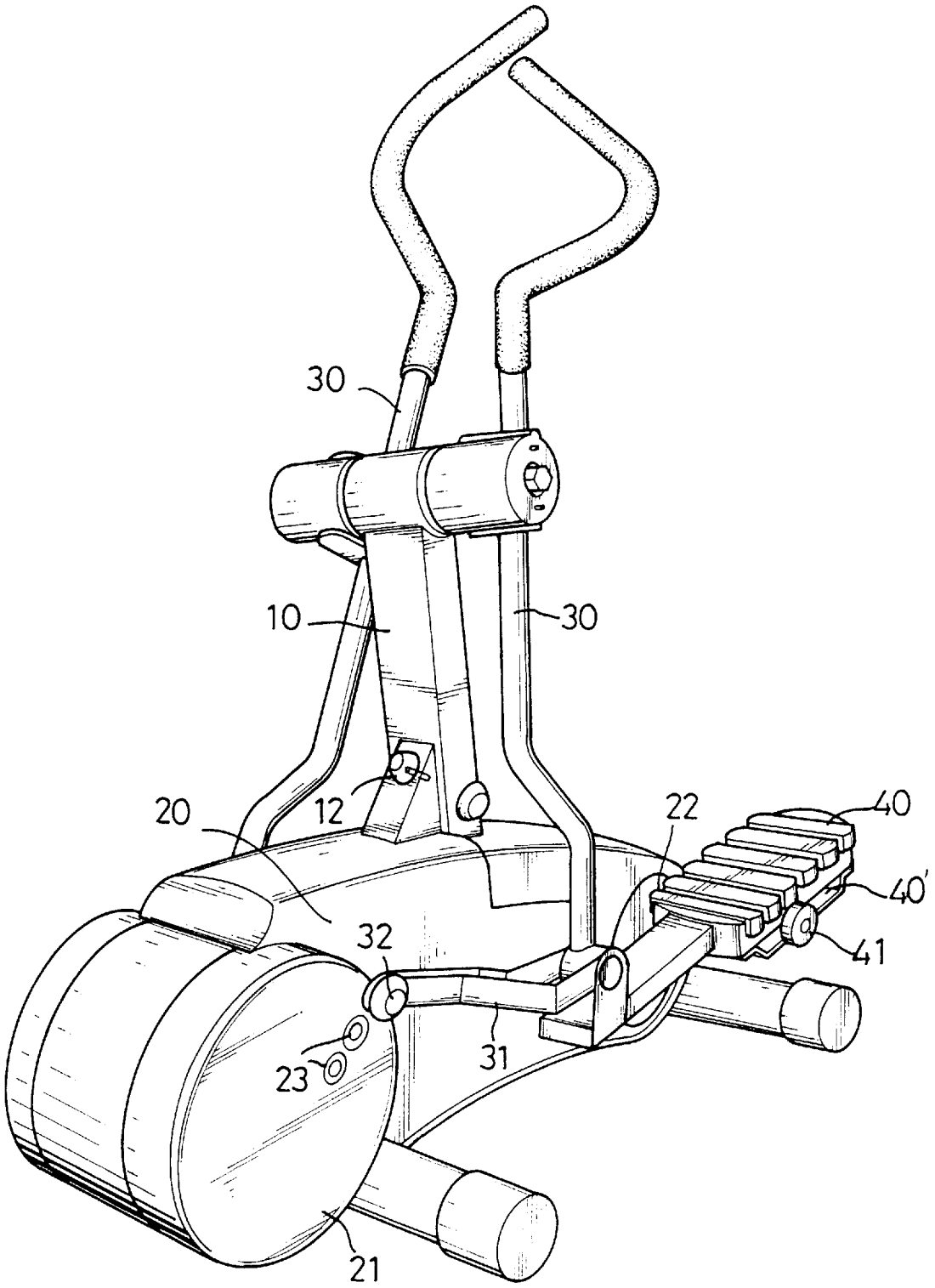
FIG. 1 is a perspective view of a typical embodiment of the present invention.
Figure 2:
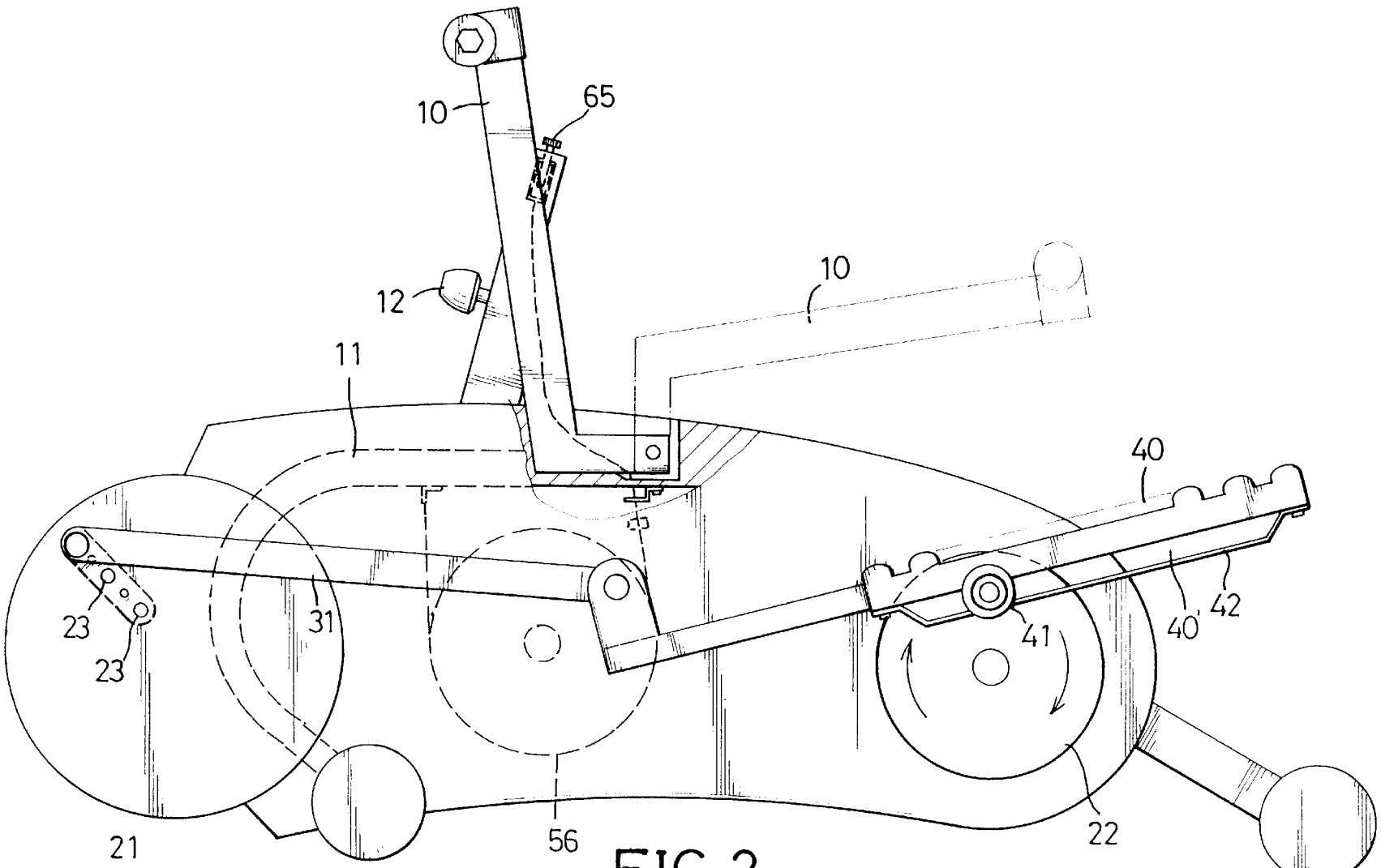
FIG. 2 is a schematic side view of the embodiment.
Figure 4:
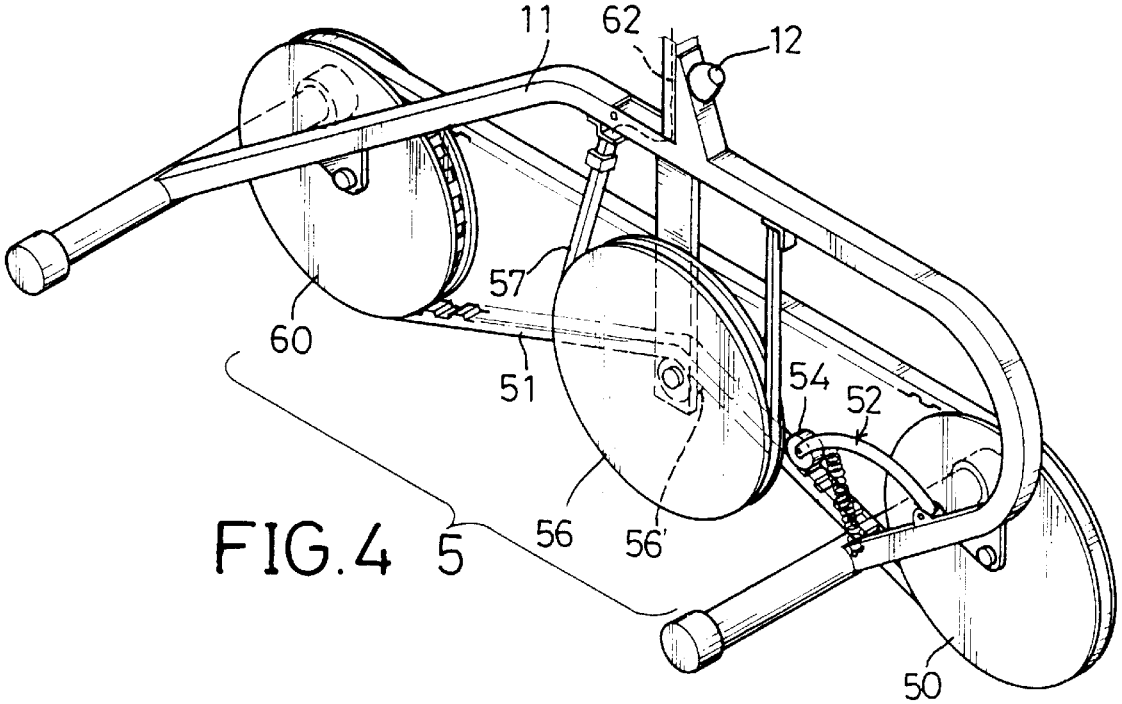
FIG. 4 is a perspective view of the embodiment wherein an energy-transmitting mechanism is shown.
Figure 5:
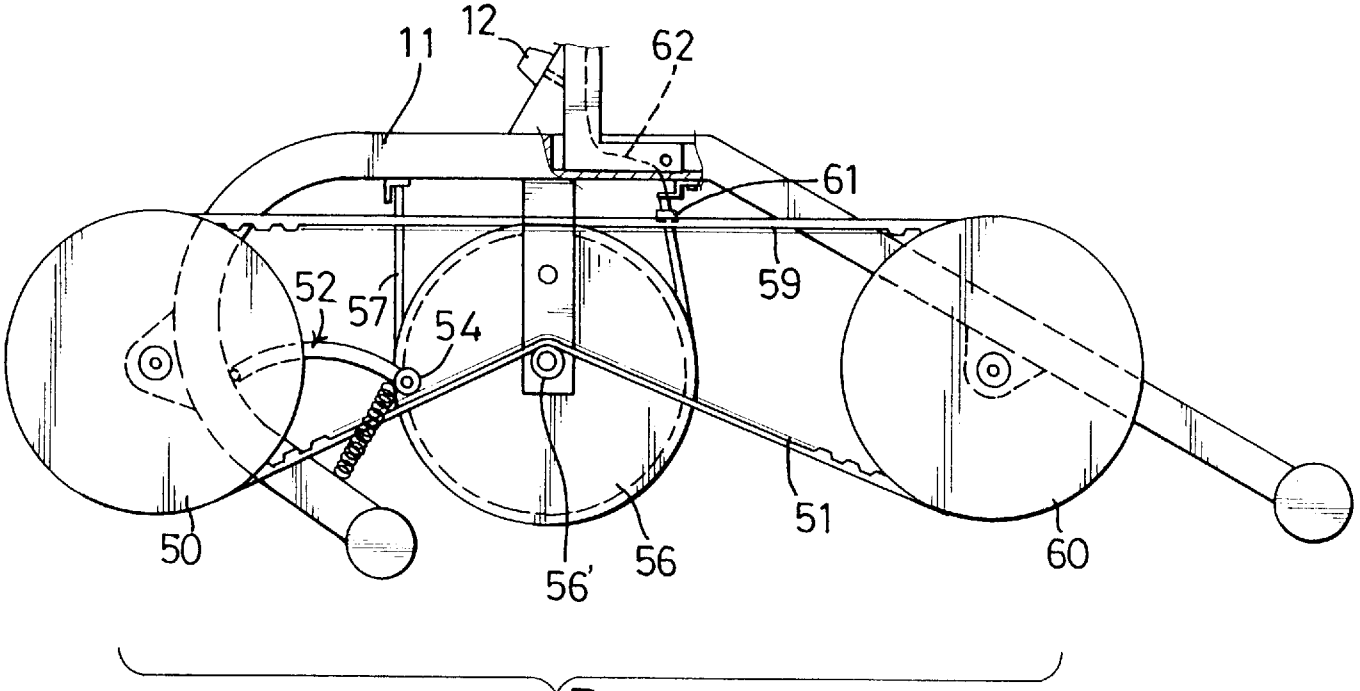
FIG. 5 is a side view of the embodiment wherein the energy-transmitting mechanism is shown.

Referring to FIGS. 1 and 2, a typical embodiment of the present invention comprises a frame 11, an energy-transmitting mechanism (not shown), a first drum 22, a second drum 21 and a pair of pedals 40. The energy-transmitting mechanism (not shown) is mounted on the frame 11. One example of the energy-transmitting mechanism is shown in FIG. 4, indicated as reference numeral 5, and will be fully described below.

Figure 7:
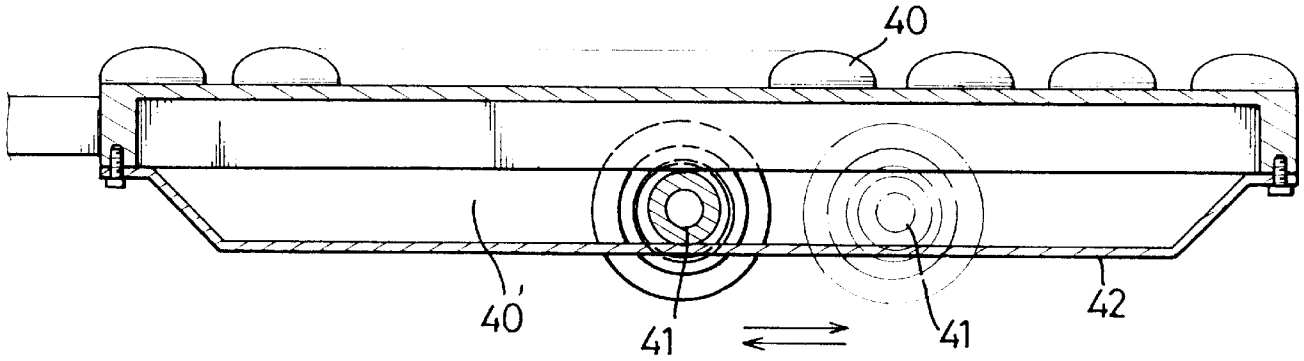
FIG. 7 is a schematic plan view wherein the rolling movement action of the pedal is shown.
Figure 8:
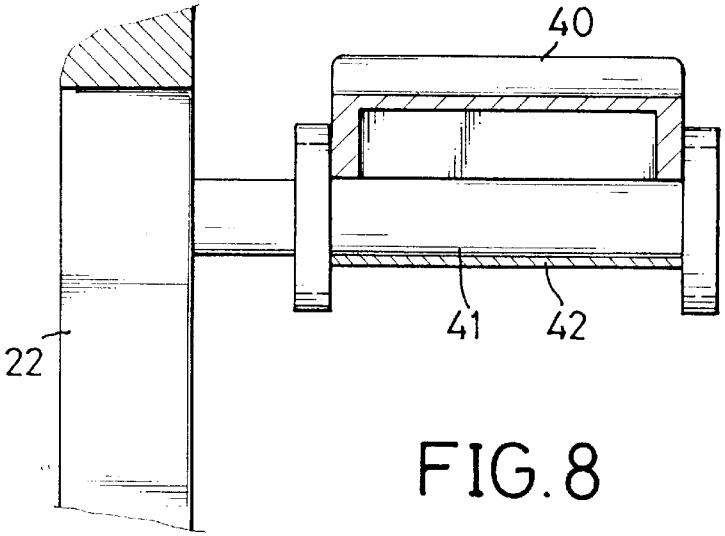
FIG. 8 is a schematic view wherein the pedal is shown.

The first drum 22 is interactively coupled with the energy-transmitting mechanism for transmitting rotational energy thereto. The second drum 21 is interactively coupled with the energy-transmitting mechanism for transmitting rotational energy thereto. Each pedal 40 has an elongate slot 40' defined therein so as to receive a rolling element 41 therein. One end of the rolling element 41 is rollingly and eccentrically connected with one end surface of the first drum 22 for rotating the first drum 22 (see FIGS. 7 and 8). As shown in FIG. 1, each pedal 40 is pivotably connected with one end surface of the second drum 21 by an elongate connecting rod 31, wherein each rolling element 41 is received in the elongate slot 40' to be capable of rolling along the elongate slot 40' of the pedal 40 when rotating the first drum 22 (see FIG. 7). One end of each connecting rod 31 is pivotably connected with one end of each pedal 40; another end of each connecting rod 31 is pivotably and eccentrically connected with the aforementioned one end surface of the second drum 21.

It is to be noted that the two connecting rods 31 are connected, at a position connectedly disposed from each other at a predetermined angle (such as 180 degrees), respectively with the two end surfaces of the second drum 21, so that the two pedals 40 can be alternatively stepped down to drive the front and second drums into rotation.

Figure 6:
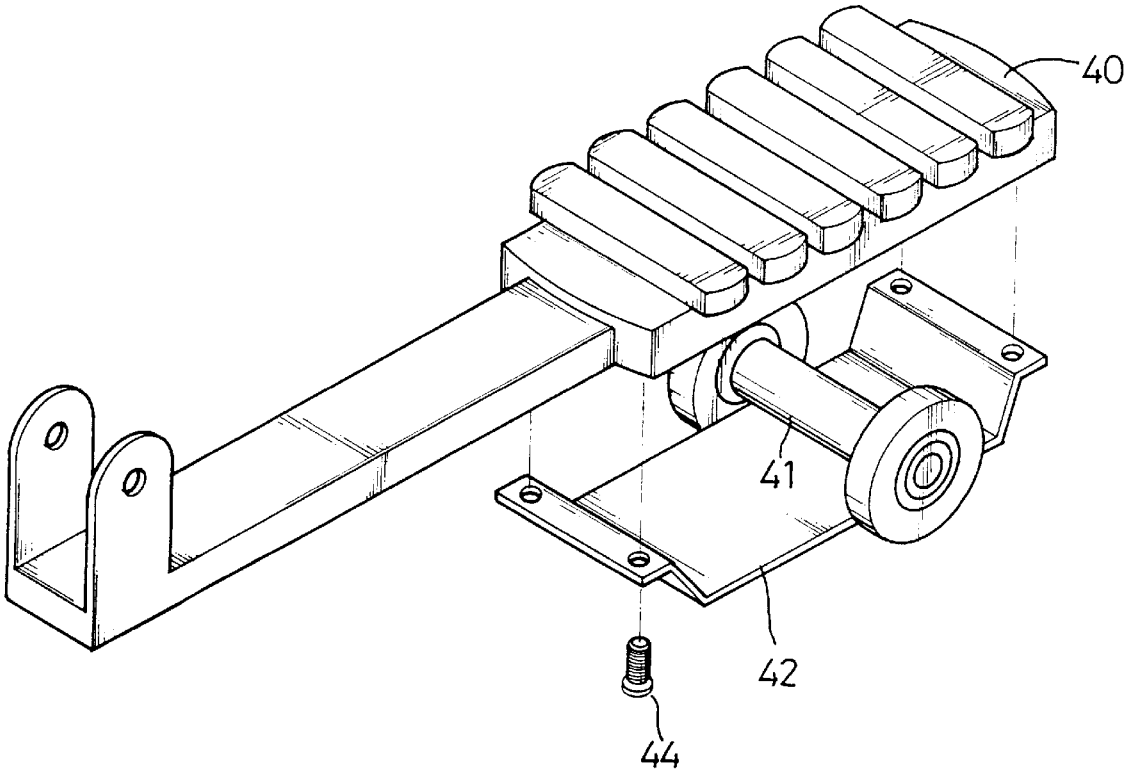
FIG. 6 is an exploded view showing a pedal assembly.

Referring to FIG. 6, the aforementioned slot 40' can be defined by means of a approximately U-shaped bracket 42 fixedly mounted onto the pedal 40 through a number of screws 44.

Referring back to FIG. 1 each one end surface of the second drum 21 can define a plurality of holes 23, wherein each hole 23 is arranged at a different distance from the center of the second drum 21, whereby the aforementioned another end of the elongate connecting rod 31 can be selectively connected with one of the holes 23 by employing a pin 32 inserted therein, such that each pedal 40 can follow a plurality of moving paths upon the selection of the holes 23 when driving the first and second drums 22, 21 into rotation.

In operation, a user stands on the two pedals 40. The pedals 40 can be alternatively stepped down to drive the first and second drums 22, 21 into rotation. The stepping operation of the present invention is rendered like a person walking or running thereon. In the process of driving the first and second drums into rotation, since each rolling element 41 is rollingly movable along each elongate slot 40', each pedal 40 can be moved relative to each rolling element 41, rendering each pedal 40 to follow a smooth path. The smooth path with regard to each pedal 40 will render significant comfort to the user when operating the present invention.

Referring to FIG. 4, the transmitting mechanism 5 includes a first pulley 50, a second pulley 60, a flywheel 56 and an endless belt 51. The first pulley 50, the second pulley 60 and the flywheel 56 are rotatably mounted on the frame 11 which is substantially covered with a housing 20 (see FIGS. 1 and 2). The endless belt 51 is carried by the first and second pulleys 50, 60 and drivingly engaged with a central hub 56' of the flywheel 56. It is to be noted that the endless belt 51 can be a toothed belt while the first pulley 50 and the second pulley 60 each can be a toothed pulley. The first pulley 50 is coupled with the first drum 22. The second pulley 60 is coupled with the second drum 21. Since the flywheel 56 is functioned as an energy reservoir which can balance the rotational speeds of the first and second drums, the stepping energy applied to each pedal 40 can be smoothly transmitted to the first and second drums.

Preferably, the energy-transmitting mechanism 5 may further include an idler assembly 52 which employs a roller 54 to be spring-biasedly engaged with the endless belt 51 for keeping the endless belt 51 in due tension.

Figure 3:
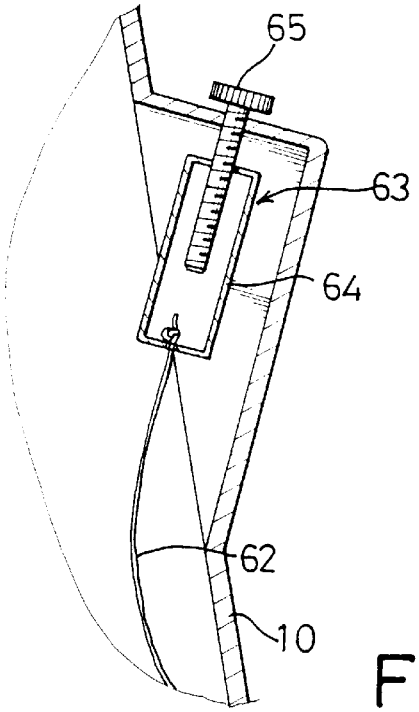
FIG. 3 is an enlarged fragmentary view of the embodiment wherein an adjusting means is shown.

Preferably, the energy-transmitting mechanism 5 may further include a braking belt 57 which is frictionally engaged in a groove defined in the rim of the flywheel 56. One end of the braking belt 57 is fixedly mounted on one part of the frame 11; another end of the braking belt 57 is connected with an adjusting means, such as reference numeral 63 shown (see FIG. 3), as will be fully described below, for adjusting the tension of the braking belt 57, so as to change the frictional resistance applied to the flywheel 56. Therefore, users may choose a suitable resistance according to their physical strength for exercising.

Referring again to FIGS. 3 and 4, the adjusting means 63 includes a hollow cylinder 64 and an adjusting screw 65, wherein the adjusting screw 65 is threadedly received in a hole defined in one part of the housing 10 and a hole defined in the top surface of the hollow cylinder 64, while the bottom surface of the hollow cylinder 64 is connected with aforementioned another end of the braking belt 57 through a wire 62. Thereby, when turning the adjusting screw 65, the hollow cylinder 64 can be moved upwardly or downwardly to adjust the tension of the braking belt 57.

Furthermore, as can be seen in FIGS. 1 and 2, the present invention may comprise a pair of handlebars 30 pivotably mounted on a vertical post 10 which is mounted on the frame 11. One end of each handlebar 30 is pivotably connected with the aforementioned one end of each pedal 40 and the aforementioned one end of each connecting rod 31 for facilitating the rotation of the first and second drums 22, 21 in the beginning of operating the present invention. Also, the handlebars can assist the user to keep balance during operation.

Preferably, the vertical post 10 can be mounted on the frame 11 in a collapsible form, wherein a knob 12 can be employed to affix the vertical post 10 onto one part of the housing 20. Thereby, when releasing the knob 12, the vertical post 10 can be collapsed down to reduce the volume of the embodiment for saving storage space.

It is to be understood, however, that even though numerous characteristics and advantages of the present invention have been set forth in the forgoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A foot exercising device comprising:

a frame;

an energy-transmitting mechanism mounted on said frame;

a first drum interactively coupled with said energy-transmitting mechanism for transmitting rotational energy thereto;

a second drum interactively coupled with said energy-transmitting mechanism for transmitting rotational energy thereto; and a pair of pedals, each pedal having an elongate slot to receive a rolling element therein, one end of said rolling element is rollingly and eccentrically connected with one end surface of said first drum for rotating said first drum, each pedal being pivotably connected with said second drum by an elongate connecting rod, wherein each said rolling element is received in each said elongate slot to be capable of rolling along each said elongate slot of each said pedal, one end of each said connecting rod is pivotably connected with one end of each said pedal, another end of each said connecting rod is pivotably and eccentrically connected with said one end surface of said second drum; whereby said pedals can be alternatively stepped down to drive said first and second drums into rotation and to follow a smooth path.

2. A foot exercising device as claimed in claim 1, wherein each one end surface of said second drum has a plurality of holes defined therein, each hole being arranged at a different distance from the center of said second drum, whereby said another end of said elongate connecting rod can be selectively connected with one of said holes by a pin.

3. A foot exercising device as claimed in claim 1, wherein said energy-transmitting mechanism includes a first pulley, a second pulley, a flywheel and an endless belt, wherein said first pulley, said second pulley and said flywheel are rotatably mounted on said frame, said endless belt is carried by said first and second pulleys and drivingly engaged with a central hub of said flywheel, said first pulley is coupled with said first drum, said second pulley is coupled with said second drum, such that energy transmitted to said pedal can be smoothly transmitted to said first and second drums.

4. A foot exercising device as claimed in claim 3, wherein said energy-transmitting mechanism further includes an idler assembly which includes a roller to be spring-biasedly engaged with said endless belt for keeping said endless belt in due tension.

5. A foot exercising device as claimed in claim 4, wherein said energy-transmitting mechanism further includes a braking belt frictionally engaged in a groove defined in a rim of said flywheel, wherein one end of said braking belt is fixedly mounted with said frame, another end of said braking belt is connected with an adjusting means for adjusting the tension of said braking belt.

6. A foot exercising device as claimed in claim 5, wherein said adjusting means includes a hollow cylinder and an adjusting screw, wherein said adjusting screw is threadedly received in a hole defined in one part of said housing and a hole defined in a top surface of the hollow cylinder, while a bottom surface of said hollow cylinder is connected with said another end of said braking belt via a wire; whereby when turning said adjusting screw, the tension of said braking belt can be adjusted.

7. A foot exercising device as claimed in claim 1, further comprising a pair of handlebars pivotably mounted on a vertical post which is mounted on said frame, one end of each said handle-bar is pivotably connected with said one end of each said pedal and said one end of each said connecting rod for facilitating the rotation of said first and second drums in the beginning of operating said device.

8. A foot exercising device as claimed in claim 7, wherein said vertical post is mounted on said frame in a collapsible form through a knob, whereby when releasing said knob, said vertical post can be collapsed down to reduce the volume of said device.

* * * * *